US006137888A

United States Patent [19]

McClennon et al.

[11] Patent Number: 6,137,888

[45] Date of Patent: Oct. 24, 2000

[54] EM INTERFERENCE CANCELLER IN AN AUDIO AMPLIFIER

[75] Inventors: Robert Scott McClennon; Leigh Alynne Thorpe, both of Ottawa, Canada

[73] Assignee: Nortel Networks Corporation, Montreal, Canada

[21] Appl. No.: 08/867,537

[22] Filed: Jun. 2, 1997

[51] Int. Cl.[7] ..... H04R 25/00

[52] U.S. Cl. ..... 381/318; 455/296; 455/223; 455/222; 455/310; 381/317; 381/315; 381/71.2; 381/93

[58] Field of Search ..... 381/312, 314, 381/315, 317–318, 323, 712, 93, 95; 455/296, 310, 222, 223, 93

[56] References Cited

U.S. PATENT DOCUMENTS

| | | | |
|---|---|---|---|
| 1,973,197 | 9/1934 | Baker | 255/10 |
| 2,282,977 | 5/1942 | Mast | 60/52 |
| 2,526,388 | 10/1950 | Miller | 60/54.5 |
| 2,555,426 | 6/1951 | Trautman et al. | 60/52 |
| 2,560,676 | 7/1951 | White | 60/51 |
| 2,645,900 | 7/1953 | Hutchison | 60/52 |
| 2,651,914 | 9/1953 | Joy | 60/51 |
| 2,699,154 | 1/1955 | Smith | 121/164 |
| 2,726,512 | 12/1955 | Deitrickson | 60/51 |
| 2,728,193 | 12/1955 | Bacchi | 60/51 |
| 2,729,942 | 1/1956 | Billings et al. | 60/52 |
| 2,838,910 | 6/1958 | Bacchi | 60/52 |
| 2,853,057 | 9/1958 | McAuley | 121/150 |
| 2,982,100 | 5/1961 | Sinclair | 60/51 |
| 3,491,538 | 1/1970 | Pearson | 60/52 |
| 3,906,257 | 9/1975 | Ivas | 307/231 |
| 4,546,607 | 10/1985 | Kime | 60/372 |
| 4,631,918 | 12/1986 | Rosman | 60/372 |
| 4,646,517 | 3/1987 | Wright | 60/371 |
| 4,680,798 | 7/1987 | Neumann | 381/315 |
| 4,707,993 | 11/1987 | Kime | 60/372 |
| 4,762,473 | 8/1988 | Tieben | 417/399 |
| 4,790,019 | 12/1988 | Hueber | 381/68.4 |
| 4,815,140 | 3/1989 | Wagner | 381/93 |
| 4,848,085 | 7/1989 | Rosman | 60/372 |
| 5,129,003 | 7/1992 | Saruta | 381/71 |
| 5,267,321 | 11/1993 | Lanberg | 381/72 |
| 5,359,448 | 10/1994 | Laslo | 359/180 |
| 5,402,496 | 3/1995 | Soli et al. | 381/94 |
| 5,412,734 | 5/1995 | Thomasson | 351/83 |
| 5,412,735 | 5/1995 | Engebretson et al. . | |
| 5,447,026 | 9/1995 | Stanley | 60/372 |
| 5,475,759 | 12/1995 | Engebretson et al. . | |
| 5,946,609 | 8/1999 | Morey | 455/336 |
| 6,035,184 | 3/2000 | Koh | 455/255 |

OTHER PUBLICATIONS

Tieben Inc. Brochure, U.S.A., Publication date unknown.

Peacock Inc. Brochure, Canada, Publication date unknown.

*Primary Examiner*—Wing F. Chan

*Assistant Examiner*—Dionne N. Harvey

[57] ABSTRACT

A problem in hearing aids or other audio/acoustic amplifier circuits is that external sources of EM energy may be coupled into the electronics of the hearing aid so as to contribute to the acoustic output. The invention provides a circuit for removing the effects of EM interference. A separate reference generator is used to detect the external EM energy. This is fed into an interference canceller which may be adaptive, which effectively removes the unwanted component in the hearing aid signal, leaving only a signal representative of the desired acoustic output.

25 Claims, 6 Drawing Sheets

EM INTERFERENCE CANCELLER IN AN AUDIO AMPLIFIER

FIELD OF THE INVENTION

The invention relates to a system for cancelling RF interference in audio amplifiers.

BACKGROUND OF THE INVENTION

The function of an audio amplifier is to take an input audio signal, amplify and process it as necessary, and produce an output audio signal. Radiated EM (electromagnetic) signals, such as those from nearby wireless equipment, having a transmitted power envelope with frequency components in the audio band, may be picked up at some point in the audio equipment. This interference can be inadvertently demodulated into audioband components in the audio amplifier circuitry (for example by a FET in an electret microphone) and added to the desired signal. These interference signals may then be output along with the desired signal resulting in an undesired noise component in the output signal.

Acoustic amplifiers include audio amplifier circuitry and thus are susceptible to the above-described problem of EM interference. In an acoustic amplifier, an input acoustic signal is converted to an audio signal which is input to the audio amplifier circuitry where it is amplified and processed. The output of the audio amplifier circuitry is reconverted into an amplified output acoustic signal.

EM interference can be a serious problem in hearing aids in which amplifiers with a large gain and amplitude compression are usually employed. The most important input to a hearing aid is a desired acoustic input, and the most important output of a hearing aid is a processed and amplified acoustic output. The desired acoustic signal is transduced into an electrical signal, processed and amplified by electronic components in the hearing aid, and converted back or transduced into the output acoustic signal. Depending on the frequency characteristics and power envelope of any interfering EM signals, these can be transduced along with the desired electrical signal to produce an audible interference component in the amplified sound produced by the hearing aid.

Typically, for an EM source to cause interference in a hearing aid, the source must be quite close to the hearing aid, and must possess certain EM characteristics such as a non-constant envelope. For example EM radiation from television sets, computer monitors, and neon lighting systems can interfere with hearing aid operation. More recently, digital cellular telephony, whose signals meet these conditions has become a problem in this area. With the increasingly widespread use of digital cellular telephones, a technique for eliminating their interference effects upon hearing aids is desired.

It is common in many types of audio equipment to employ techniques for reducing or cancelling noise or interference. In contrast to the above described situation in which an inadvertently received EM signal interferes with an internally generated audio signal, existing systems deal with interfering signals which are received in the same physical manner as the desired signals. For example, in hearing aids which have a microphone and a speaker portion, acoustic feedback from the speaker into the microphone may exist, and adaptive equalization may be employed in the hearing aid to reduce or minimize the negative effects of the feedback upon the operation of the hearing aid.

Three existing systems which employ such a technique for reducing acoustic feedback are disclosed in U.S. Pat. No. 5,412,735 by Engebretson et al. which issued May 2, 1995 entitled "Electric Filter Hearing Aids and Methods", U.S. Pat. No. 5,475,759 by Engebretson et al. which issued Dec. 12, 1995 entitled "Adaptive Noise Reduction Circuit for a Sound Reproduction System" and U.S. Pat. No. 5,402,496 by Soli et al. which issued Mar. 28, 1995 entitled "Auditory Prosthesis Noise Suppression Apparatus and Feedback Suppression Apparatus Having Focused Adaptive Filtering".

As another example, noise cancellation systems exist for the purpose of cancelling acoustic background noise. These systems employ a main microphone near the desired sound source, and a noise reference microphone near the source of the noise, for example, a vent fan. The main microphone will s till pick up unwanted noise from the fan. The inputs from the main microphone and the noise microphone are combined so as to remove from the main microphone the effects of the ventilation noise. The performance of such active noise cancellation systems is also compromised when the noise reference microphone can pick up some of the desired sound signal as well as the acoustic noise signal.

SUMMARY OF THE INVENTION

It is an object of the invention to provide an audio amplifier with increased immunity to interference from nearby EM sources.

According to a first broad aspect, the invention provides an interference canceller circuit for use in an audio amplifier, the audio amplifier having electronic circuitry which generates an electric signal which includes a desired audio signal component and which may include a component due to externally generated EM energy inadvertently coupled into the electronic circuitry, the interference canceller circuit comprising: an EM reference signal generator for generating a reference EM signal representative of the externally generated EM energy; and an interference canceller network connected to receive the reference EM signal and to cancel from the electric signal the component due to the externally generated EM energy.

According to a second broad aspect, the invention provides an audio amplifier comprising electronic circuitry for amplifying and processing an electrical signal and an interference canceller circuit for reducing the effect of spurious externally generated EM energy being coupled into the electronic circuitry; the interference canceller circuit comprising an EM reference signal generator for generating a reference EM signal representative of the externally generated EM energy; and an interference canceller network connected to receive the reference EM signal and to cancel from the electrical signal the component due to the externally generated EM energy.

According to a third broad aspect, the invention provides an acoustic signal amplifier comprising an input transducer for converting an acoustic signal into an electrical signal, electronic circuitry for amplifying and processing the electrical signal, an output transducer connected to the electronic circuit to derive an amplified acoustic signal, an interference canceller circuit for reducing the effect upon the amplified acoustic signal of spuriously generated EM energy inadvertently coupled into the electronic circuitry, the interference canceller circuit comprising: an EM reference signal generator for generating a reference EM signal representative of the externally generated EM energy; and an interference canceller network connected to receive the reference EM signal and to cancel from the electric signal the component due to the externally generated EM energy.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
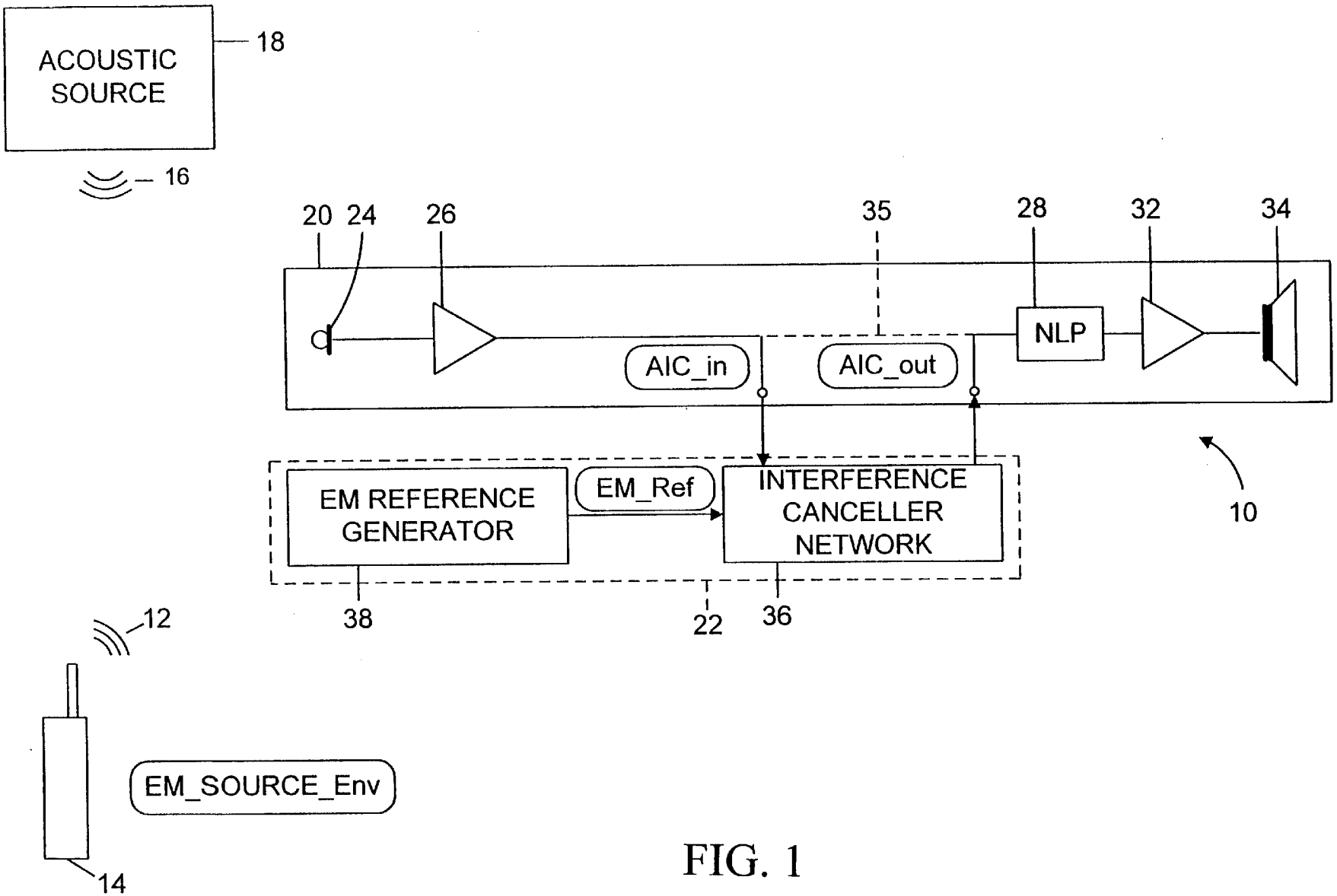
FIG. 1 is a block diagram of a hearing aid equipped with an EM interference canceller circuit according to the invention.

FIG. 1 is a functional block diagram of an acoustic amplifier such as a hearing aid, generally indicated by 10, in the context of an environment containing an EM interference signal 12 generated by an EM source 14 which is nearby, and also containing desired acoustic signals 16 generated by an acoustic source 18. The EM source 14 may be a wireless handset, for example, while the acoustic source 18 may be a person speaking, for example. The hearing aid 10 includes the functionality of a conventional hearing aid, generally indicated by 20, and an interference canceller circuit according to the invention, generally indicated by 22.

The conventional hearing aid functionality 20 includes an input transducer such as a microphone 24 for receiving acoustic signals 16 produced by the acoustic source 18 and converting the acoustic signals 16 to electrical signals. The conventional hearing aid functionality further includes an input amplifier 26, an NLP (non-linear processing block) 28 followed by an output amplifier 32, and produces an output acoustic signal with an output transducer such as a speaker 35. The NLP block 28 may include signal-level dependent equalization and compression functions, for example. The input amplifier 26, NLP 28 and output amplifier 32 are all realized with electronics forming part of the hearing aid 10. In conventional hearing aids, the output of the input amplifier 26 is connected directly to the NLP 28 as indicated by dotted line 35.

The source of EM energy 14 is producing an EM signal labelled EM_SOURCE having a signal envelope equal to EM_SOURCE Env. The printed circuit traces and electronics within the hearing aid 10 may behave like an antenna so as to receive components of the EM signal generated by the EM source 14. These received EM signals may be inadvertently demodulated by the hearing aid electronics so as to contribute to the acoustic output of the speaker in the form of unwanted acoustic noise.

According to the invention, the hearing aid is equipped with an interference canceller circuit 22. In place of the direct connection 35 between the input amplifier 26 and the NLP block 28, an interference canceller network 36 forming part of the interference canceller circuit 22 is connected to receive an input from the input amplifier 26 and to pass an output to the NLP block 28. The input to and output from the interference canceller network 36 are labelled AIC_in and AIC_out respectively. An EM reference generator 38, also forming part of the interference canceller circuit 22 and shown connected to the interference canceller network 36, is used to generate a "reference" or model of the interfering EM field power envelope EM_SOURCE_Env for use by the interference canceller network. The reference generated by the EM reference generator 38 is labelled EM_Ref.

Figure 2:
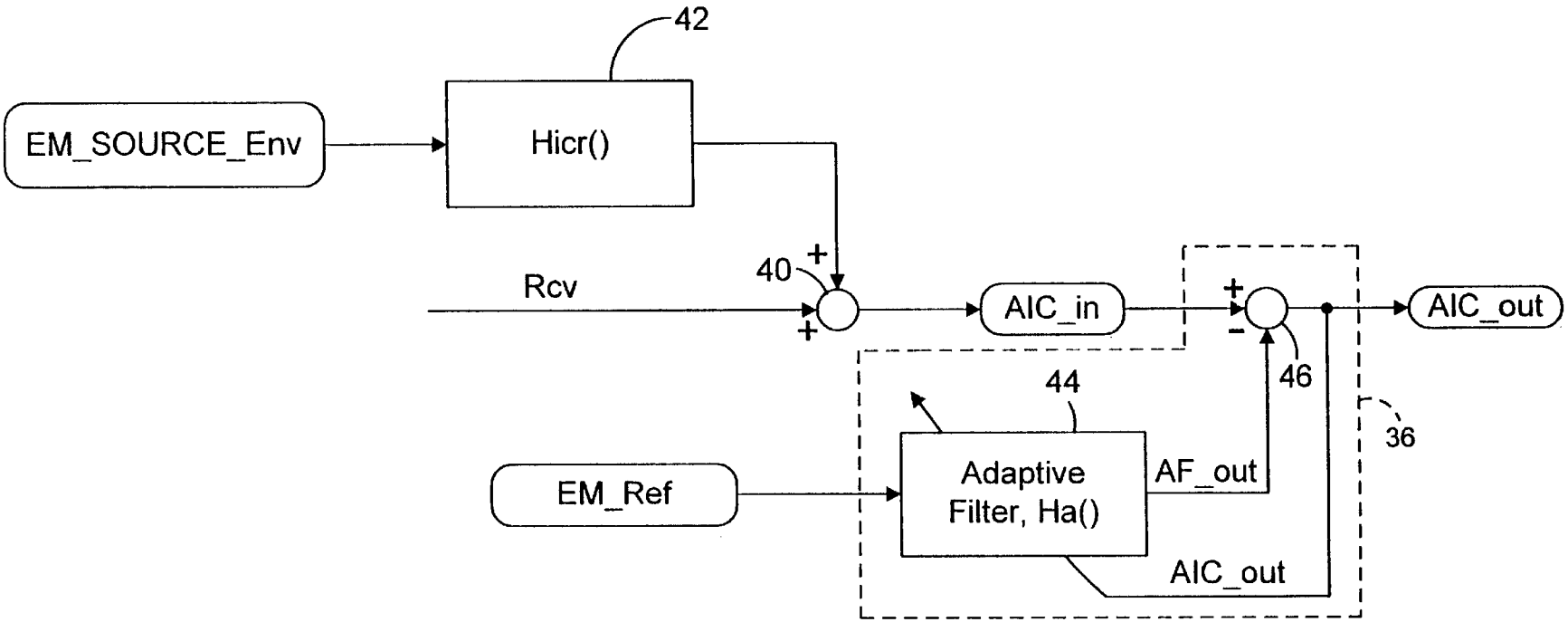
FIG. 2 is a signal flow diagram for a portion of the hearing aid of FIG. 1.

Referring now to FIG. 2, a signal flow diagram for part of the hearing aid of FIG. 1 is shown. As indicated by an adder symbol 40, the signal AIC_in is the sum of two components the first of which is an "ideal" audio signal, labelled Rcv, which is the electrical signal which would be produced at the output of the input amplifier 26 due to the acoustic signal 16 in the absence of any interfering EM signals. The second component of the signal AIC_in is due to the interfering EM signal 12 having a signal envelope equal to EM_SOURCE_Env. The EM signal envelope EM_SOURCE_Env is not added directly to the desired signal Rcv at the input to the interference canceller network 36, but is modified by the electronics in the hearing aid. The effects of the hearing aid electronics upon the EM signal envelope may be modelled as a transfer function. The transfer function between EM_SOURCE_Env and the input to the interference canceller network 36 is referred to as the interferer channel response, Hicr( ) 42.

Depending on how well the reference signal EM_ref matches the interference component of AIC_in (this being Hicr( )*EM_SOURCE_Env) and on the degree of cancellation sought, the interference canceller network can be fixed or made adaptive. By way of example, it is assumed that the interference canceller network is adaptive.

In this case, the interference canceller network 36 has an adaptive filter network having a transfer function Ha( ) 44 for producing a correction signal AF_out as a function of the reference signal EM_ref and the output of the interference canceller AIC_out. The correction signal AF_out is subtracted from AIC_in to produce AIC_out, as indicated by a subtraction symbol 46. The output of the interference canceller network 36 may be written as:

$$AIC_out = Rcv + (Hicr(\ )*EM_SOURCE_Env - Ha(\ )*EM_Ref)$$

In a well designed system, EM_Ref will be a good approximation of EM_SOURCE_Env, and the transfer function of the adaptive filter, Ha( ), when converged, will be a good approximation of Hicr( ). Substituting these approximations into the above equation yields:

$$AIC_out \geqq Rcv + (Hicr(\ )*EM_SOURCE_Env - Hicr(\ )*EM_SOURCE_Env) \equiv Rcv$$

which is the desired result, since it does not contain any effects of the interfering signal, EM_SOURCE_Env.

The interference canceller network 36 is a classic interference or "noise" canceller design. The adaptive filter may use a LMS (least mean square) algorithm or other adaptation control schemes. The filter transfer function Ha(s) 44 is adapted so as to minimize the correlation between the output AIC_out of the interference canceller circuit 22 and the interfering signal approximated by EM_Ref. It is important that the adaptive filter have a convergence speed which is sufficient to keep up with changes in the interference channel response, Hicr( ) which are not matched by the EM_ref generator 38. In this example, these changes may result from the relative position of the EM source changing as a function of the hearing aid user's position and head orientation.

Figure 3A:
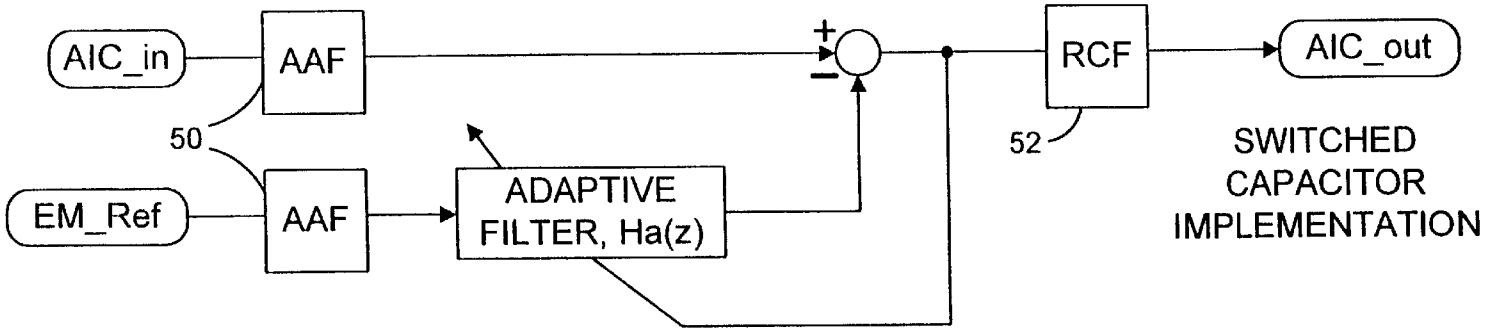
FIG. 3*a* is a signal flow diagram for a switched capacitor implementation.
Figure 3B:
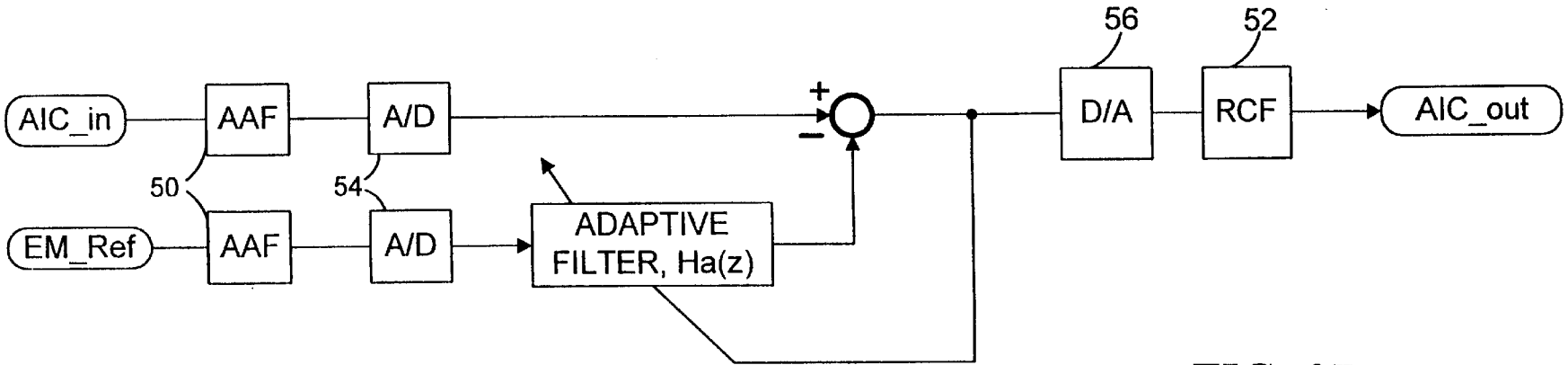
FIG. 3*b* is a signal flow diagram for a digital signal processing implementation.

The adaptive interference canceller network may be implemented using a sampled data system, for example. By way of example, two possible realizations include switched capacitor or digital. FIG. 3*a* is a signal flow diagram similar to FIG. 2 for a switched capacitor implementation and FIG. 3*b* is a signal flow diagram similar to FIG. 3*a* for a digital signal processing implementation. Both of these approaches require AAFs (anti-aliasing filters) 50 before sampling and RFCs (reconstruction filters) 52 after sampling. The digital implementation also requires A/D (analog-to-digital) converters 54 and a D/A (digital-to analog) converter 56.

The interfering EM signal may be generated by a handset which is being used by the user of the hearing aid, or may be generated by another source unrelated to the hearing aid user. The EM reference signal generator may be tailored to specifically deal with EM signals generated by the hearing aid user's handset, or may be designed to handle all EM signals.

Figure 6:
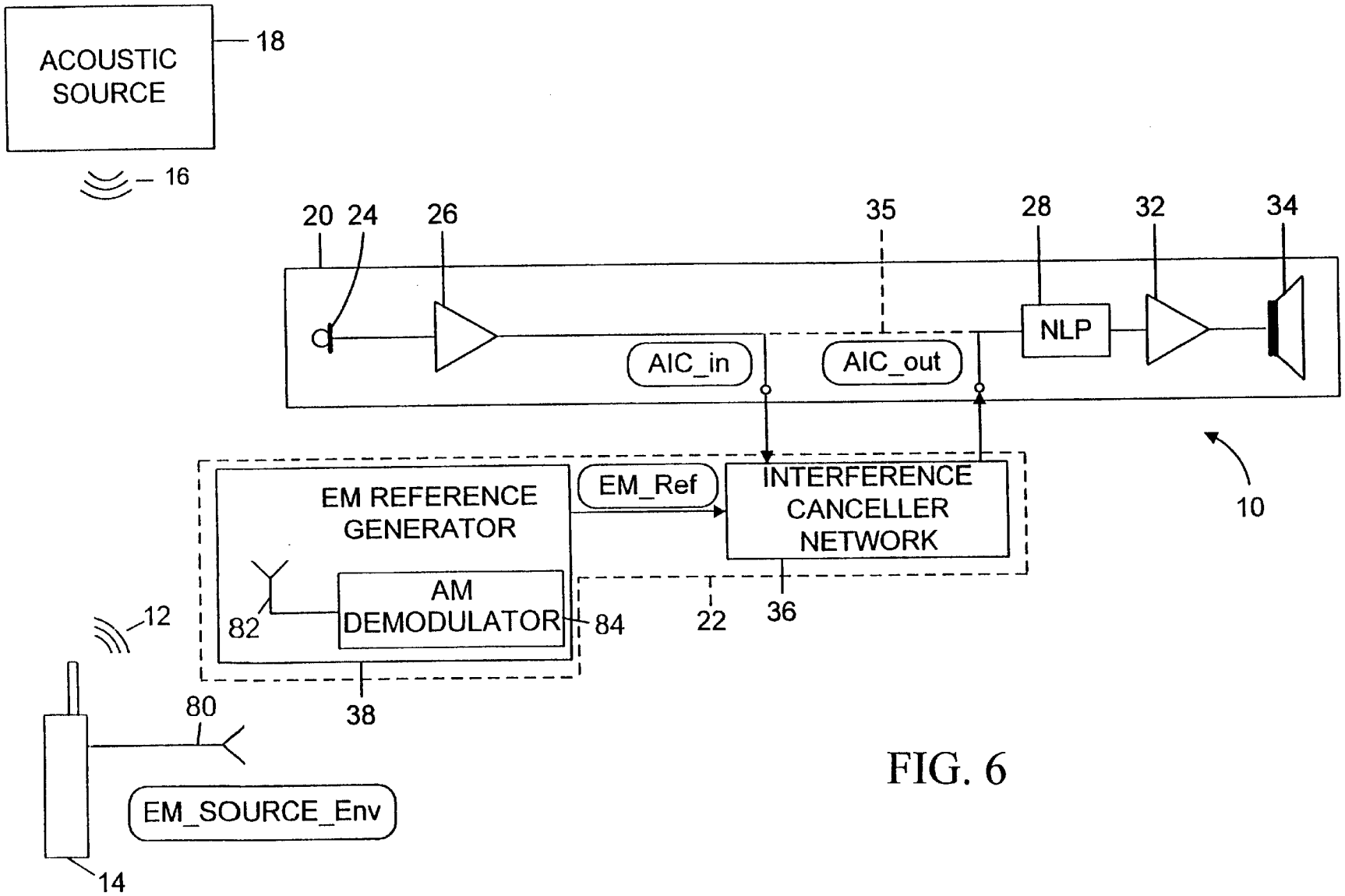
FIG. 6 is a block diagram of the hearing aid of FIG. 1 in which the EM reference generator is an antenna and AM demodulator.

In a first option for generating the reference signal EM_Ref, the reference signal generator is a simple AM-type power detector which simply detects the envelope of radiated EM power. An example of this is shown in FIG. 6 in which an antenna 82 and AM demodulator 84 are shown. In a preferred implementation a detector which models the interference pickup mechanism in the acoustic amplifier/audio amplifier/hearing aid is used. For a hearing aid this mechanism would typically be the microphone circuit (an electret with a FET device). A reference generator circuit which matches the circuit picking up the interference (including similar circuit layout topology and the microphone itself with the acoustic pickup disconnected) would provide an output similar to the interference signal. This would simplify the adaptive interference canceller's task and would even permit a limited amount of cancellation by simply subtracting this reference from the input AIC_in the interference canceller circuit without the requirement for an adaptive filter. In this case, interfering signals generated by the user's handset will be treated the same as interfering signals generated by other sources.

Figure 4:
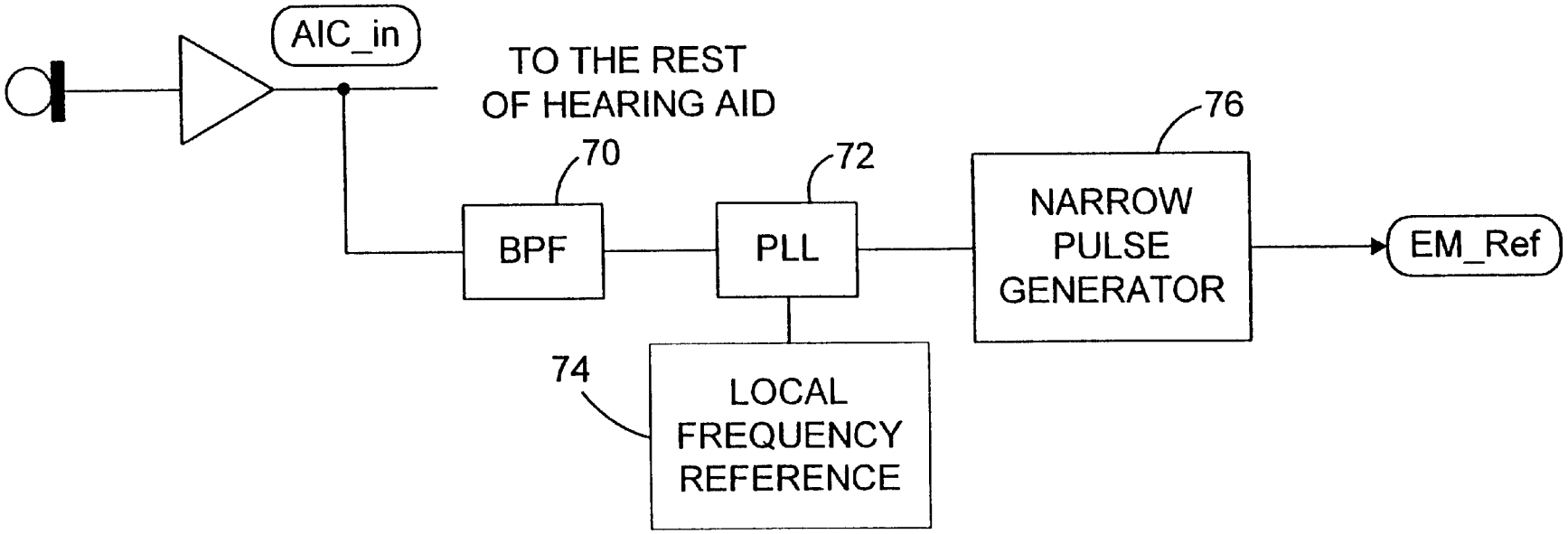
FIG. 4 is a block diagram of an EM reference generator using a phase-locked loop.

For interfering signals which are periodic in nature, such as TDMA (time division multiple access) signals generated by mobile handsets or base stations, the spectrum of the interfering noise is centred around a particular frequency. In this case, a second option for generating the reference signal EM_Ref exists in which the reference signal is frequency-locked to the input to the reference generator (AIC_in) with a PLL (phase-locked loop). A block diagram of an EM reference generator using a PLL is shown in FIG. 4. The input signal is AIC_in rather than a separately detected signal. It is fed through a BPF (band pass filter) 70, a PLL 72 and a narrow pulse generator 76. A local frequency reference 74 provides a reference frequency input to the PLL 72 with a frequency set to approximate the interference power envelope frequency. This assumes the interfering signal frequency is known and has a periodic envelope.

Figure 5:
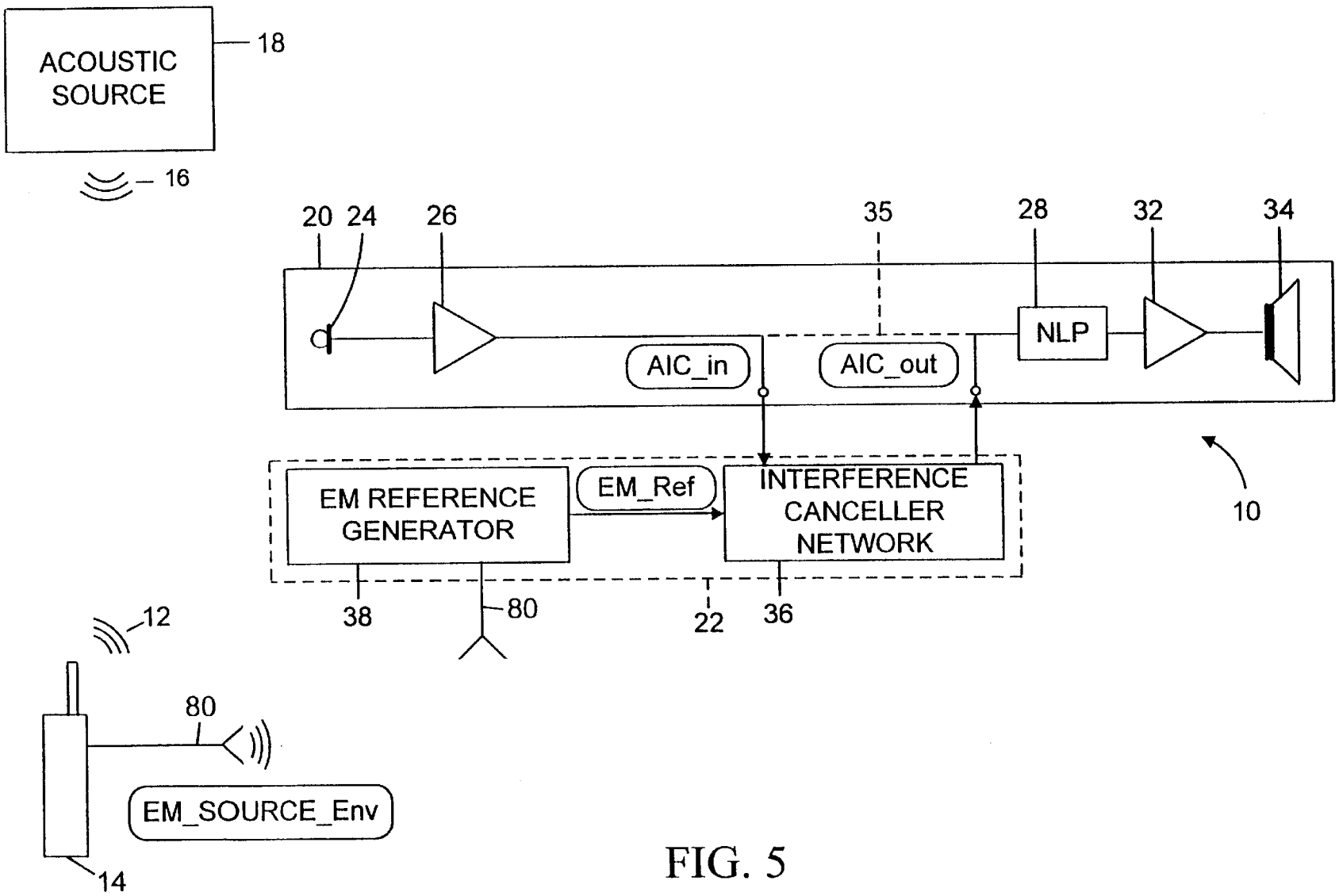
FIG. 5 is a block diagram of the hearing aid of FIG. 1 showing an IR signal transmitted from the EM source to the hearing aid.

An option for generating the reference signal EM_Ref specifically applicable to the situation where the EM interference source is the user's handset is to use an infrared link to directly supply a reference signal from the handset to the hearing aid. An example of this is shown in FIG. 5 which shows an infrared connection 80 between the EM interference source 14 and the interference canceller circuit 22.

In the cases of the PLL-based and infrared-linked-based reference generators, the reference signal produced can only model the frequency of the interfering signal. In these cases, an adaptive interference canceller network must be used and the EM_ref signal produced is a broadband audio signal, rich in all harmonics of the interference signal envelope frequency. For example, this is the function of the narrow pulse generator in the PLL-based reference signal generator.

It is contemplated that new hearing aids may be designed with the interference cancellation mechanism according to the invention built in, and that existing hearing aids may be retro-fitted with the interference cancellation mechanism.

Numerous modifications and variations of the present invention are possible in light of the above teachings. It is therefore to be understood that within the scope of the appended claims, the invention may be practised otherwise than as specifically described herein.

While the invention has been described with reference to application in a hearing aid, it may be applied in any acoustic amplifying application.

Furthermore, while an audio amplifier application has been described, and more particularly an audio amplifier forming part of a hearing aid, it is to be understood that the invention can also be applied to other audio amplifier applications where there is no direct acoustic input, for example CD players and the like. In this case, there are no microphone and speaker components, and the input and output signals are electrical signals, perhaps originating from another component.

The embodiments of the invention in which an exclusive property or privilege is claimed are defined as follows:

1. An interference canceller circuit for use in an audio amplifier, the audio amplifier having electronic circuitry which generates an electric signal which includes a desired audio signal component and which may include a component due to externally generated EM energy inadvertently coupled into the electronic circuitry, the interference canceller circuit comprising:

an EM reference signal generator for generating a reference EM signal representative of the externally generated EM energy; and an interference canceller network connected to receive the reference EM signal and to cancel from the electric signal the component due to the externally generated EM energy.

2. A circuit according to claim 1 wherein the interference canceller network is adaptive.

3. A circuit according to claim 1 wherein the EM reference signal generator comprises an antenna and an AM demodulator.

4. A circuit according to claim 1 wherein the EM reference signal generator comprises an infrared connection to a particular source of the externally generated EM energy.

5. A circuit according to claim 1 wherein the EM reference signal generator is designed to detect periodic interfering signals having an interfering signal envelope frequency, and comprises a filter having a center frequency nominally at the interfering signal envelope frequency, followed by a phase-locked loop and narrow pulse generator to produce frequency-locked reference signal rich in harmonics of the interfering signal envelope frequency.

6. A circuit according to claim 1 wherein the interference canceller includes an adaptive filter which produces a correction signal which is subtracted from the electric signal to produce a corrected signal, and the adaptive filter is adapted to minimize the correlation between the EM reference signal and the corrected signal.

7. A circuit according to claim 1 wherein the audio amplifier forms part of an acoustic amplifier.

8. A circuit according to claim 7 wherein the acoustic amplifier is a hearing aid.

9. A circuit according to claim 1 wherein the EM reference signal generator comprises circuitry which emulates a portion of said electronic circuitry into which the component due to externally generated EM energy was coupled.

10. An audio amplifier comprising electronic circuitry for amplifying and processing an electrical signal and an interference canceller circuit for reducing the effect of spurious externally generated EM energy being coupled into the electronic circuitry;

the interference canceller circuit comprising an EM reference signal generator for generating a reference EM signal representative of the externally generated EM energy; and an interference canceller network connected to receive the reference EM signal and to cancel from the electrical signal the component due to the externally generated EM energy.

11. A circuit according to claim 10 wherein the interference canceller network is adaptive.

12. A circuit according to claim 10 wherein the EM reference signal generator comprises an antenna and an AM demodulator.

13. A circuit according to claim 10 wherein the EM reference signal generator comprises an infrared connection to a particular source of the externally generated EM energy.

14. A circuit according to claim 10 wherein the EM reference signal generator is designed to detect periodic interfering signals having an interfering signal envelope frequency, and comprises a filter having a centre frequency nominally at the interfering signal envelope frequency followed by a phase locked loop and narrow pulse generator to produce a frequency-locked reference signal rich in harmonics of the interfering signal envelope.

15. A circuit according to claim 10 wherein the interference canceller includes an adaptive filter which produces a correction signal which is subtracted from the electric signal to produce a corrected signal, and the adaptive filter is adapted to minimize the correlation between the EM reference signal and the corrected signal.

16. A circuit according to claim 10 wherein the EM reference signal generator comprises circuitry which emulates a portion of said electronic circuitry into which the component due to externally generated EM energy was coupled.

17. An acoustic signal amplifier comprising an input transducer for converting an acoustic signal into an electrical signal, electronic circuitry for amplifying and processing the electrical signal, an output transducer connected to the electronic circuit to derive an amplified acoustic signal, an interference canceller circuit for reducing the effect upon the amplified acoustic signal of spuriously generated EM energy inadvertently coupled into the electronic circuitry, the interference canceller circuit comprising:

an EM reference signal generator for generating a reference EM signal representative of the externally generated EM energy; and an interference canceller network connected to receive the reference EM signal and to cancel from the electric signal the component due to the externally generated EM energy.

18. The acoustic signal amplifier of claim 17 implemented as a hearing aid.

19. The acoustic signal amplifier of claim 17 wherein the input transducer is a microphone and the output transducer is a speaker.

20. A circuit according to claim 17 wherein the interference canceller network is adaptive.

21. A circuit according to claim 17 wherein the EM reference signal generator comprises an antenna and an AM demodulator.

22. A circuit according to claim 17 wherein the EM reference signal generator comprises an infrared connection to a particular source of the externally generated EM energy.

23. A circuit according to claim 17 wherein the EM reference signal generator is designed to detect periodic interfering signals having a interfering signal envelope, and comprises a filter having a centre frequency nominally at the interfering signal envelope frequency followed by a phase locked loop and narrow pulse generator to produce a frequency-locked reference signal rich in harmonics of the interfering signal envelope frequency.

24. A circuit according to claim 17 wherein the interference canceller includes an adaptive filter which produces a correction signal which is subtracted from the electric signal to produce a corrected signal, and the adaptive filter is adapted to minimize the correlation between the EM reference signal and the corrected signal.

25. A circuit according to claim 17 wherein the EM reference signal generator comprises circuitry which emulates a portion of said electronic circuitry into which the component due to externally generated EM energy was coupled.

* * * * *